US007742001B2

(12) United States Patent
Humphrey et al.

(10) Patent No.: US 7,742,001 B2
(45) Date of Patent: Jun. 22, 2010

(54) TWO-TIER WIDE BAND ANTENNA

(75) Inventors: Denver Humphrey, Broughshane (GB); Brian Kearns, Dublin (IE); Bee Yen Toh, Lisburn (GB)

(73) Assignee: TDK Corporation, Tokyo (JP)

( * ) Notice: Subject to any disclaimer, the term of this patent is extended or adjusted under 35 U.S.C. 154(b) by 213 days.

(21) Appl. No.: 12/078,440

(22) Filed: Mar. 31, 2008

(65) Prior Publication Data

US 2009/0243937 A1 Oct. 1, 2009

(51) Int. Cl.
*H01Q 1/38* (2006.01)

(52) U.S. Cl. ..... 343/700 MS

(58) Field of Classification Search ..... 343/700 MS, 343/702, 846

See application file for complete search history.

(56) References Cited

U.S. PATENT DOCUMENTS

| | | | | |
|---|---|---|---|---|
| 5,828,340 | A | 10/1998 | Johnson | |
| 6,300,909 | B1 * | 10/2001 | Tsubaki et al. | 343/700 MS |
| 6,693,594 | B2 * | 2/2004 | Pankinaho et al. | 343/700 MS |
| 6,803,881 | B2 * | 10/2004 | Ishihara et al. | 343/700 MS |
| 6,891,507 | B2 | 5/2005 | Kushihi et al. | |
| 7,019,698 | B2 | 3/2006 | Miyoshi et al. | |
| 7,081,859 | B2 | 7/2006 | Miyoshi et al. | |
| 7,136,020 | B2 | 11/2006 | Yamaki | |
| 7,196,663 | B2 | 3/2007 | Bolzer et al. | |
| 2004/0012530 | A1 | 1/2004 | Chen | |
| 2007/0222699 | A1 | 9/2007 | Modro | |
| 2009/0243940 | A1 * | 10/2009 | Humphrey | 343/700 MS |

FOREIGN PATENT DOCUMENTS

| | | |
|---|---|---|
| EP | 0 762 533 A2 | 3/1997 |
| JP | A-2005-203817 | 7/2005 |
| WO | WO 2006/022350 A1 | 3/2006 |

OTHER PUBLICATIONS

European Search Report issued in European Patent Application No. 09 00 4702 on Jul. 10, 2009.

* cited by examiner

*Primary Examiner*—Tho G Phan
(74) *Attorney, Agent, or Firm*—Oliff & Berridge, PLC

(57) ABSTRACT

A two-tier wideband antenna comprising a chip of a dielectric material with an upper radiating structure and a lower radiating structure, the dielectric chip being mounted on an insulating carrier substrate which includes a feed-line to connect the antenna to a transceiver device. The lower radiating structure comprises two side elements which have a large aspect ratio so as to reduce the frequency of the lower band edge of the frequency response of the antenna when compared with the frequency response of a monopole patch antenna fabricated on a similar dielectric chip. The antenna of the present invention is suitable for operation over an ultra wideband, e.g. a frequency range extending from 3.1 to 10.6 GHz.

22 Claims, 6 Drawing Sheets

| Band Group | Band | Frequency Range |
|---|---|---|
| Band Group #1 | #1 | 3168 - 3696 MHz |
| | #2 | 3696 - 4224 MHz |
| | #3 | 4224 - 4752 MHz |
| Band Group #2 | #4 | 4752 - 5280 MHz |
| | #5 | 5280 - 5808 MHz |
| | #6 | 5804 - 6336 MHz |
| Band Group #3 | #7 | 6336 - 6864 MHz |
| | #8 | 6864 - 7392 MHz |
| | #9 | 7392 - 7920 MHz |
| Band Group #4 | #10 | 7920 - 8448 MHz |
| | #11 | 8448 - 8976 MHz |
| | #12 | 8976 - 9504 MHz |
| Band Group #5 | #13 | 9504 - 10032 MHz |
| | #14 | 10032 - 10560 MHz |

TWO-TIER WIDE BAND ANTENNA

FIELD OF THE INVENTION

The present invention relates to wide band antennas, particularly, but not exclusively, for use in Ultra Wideband (UWB) systems, or systems defined by the IEEE 802.15 family of standards. The invention is particularly concerned with antennas that are suitable for integration into portable handsets for wireless communications and other wireless terminals.

BACKGROUND TO THE INVENTION

Existing 2G and 3G cellular systems such as Global System for Mobile Communications (GSM) and Universal Mobile Telephone System (UMTS) operate over a frequency band which is relatively narrow compared to the frequency of operation—for example, the UMTS system has an operating band extending from 1920 to 2170 MHz. The design of antennas offering good performance with bandwidths for one or more 2G or 3G systems is relatively well established.

Future wireless systems, such as 4G or what is commonly referred to as Long Term Evolution (LTE), will require much higher data transfer rates than existing systems, and as a result the required operating bands will become wider. The UWB systems defined by the WiMedia Alliance and the IEEE 802.15 standards describe systems with operating bands ranging from 3.1 to 10.6 GHz. At the same time, the long term evolution of wireless handsets and terminals will see an increased functionality and the capability to operate on multiple systems so that the physical dimensions of the constituent parts of each system will become necessarily smaller. For such future systems, a new type of antenna design becomes an imperative: an antenna which retains the small physical dimensions of antennas for 2G and 3G systems while offering good performance over a bandwidth extending over several GHz.

Wideband planar antennas are well known, for example U.S. Pat. No. 5,828,340, Johnson, describes a planar antenna having a 40% operational bandwidth, where the extended bandwidth is achieved by forming a tab antenna on a substrate where the tab antenna has a trapezoidal shape. Furthermore, it is known that the physical dimensions of an antenna can be reduced by fabricating the antenna on a substrate with a high dielectric constant, such as Alumina. U.S. Pat. No. 7,019,698, Miyoshi, describes a gap-fed chip antenna comprising a radiating portion formed by the union of a reversed triangular portion and a semicircular portion sandwiched between two dielectric layers and comprising a feeding portion which couples to the radiating portion. The antenna taught by Miyoshi is suitable for use as an antenna device operating according to the UWB system and has dimensions in the order of one quarter of one wavelength at an operating frequency of 6 GHz. A similar antenna is described in U.S. Pat. No. 7,081,859, Miyoshi et al.

FIG. 1 of the accompanying drawings shows a prior art monopole chip antenna comprising a dielectric chip 10, arranged on an insulating carrier substrate 15. The antenna includes a radiating element 11 fabricated on an upper surface of dielectric chip 10, a feed point, realized by a metal input/output (I/O) pad 12 fabricated on the lower surface of dielectric chip 10, a metal connecting trace 16A connecting the I/O pad 12 to radiating element 11. Carrier substrate 15 includes a feed line 17 which connects a transceiver device (not shown) to metal I/O pad 22 and a ground plane 13 offset from dielectric chip 10.

Despite the advances taught in Johnson and Miyoshi, for integration in mobile wireless handsets and terminals, antennas with further reduced physical dimensions are highly desirable. Moreover a solution to the problem of producing a highly miniaturized ultra wideband antenna with excellent performance characteristics (e.g. a return loss of less than −6 dB and a high radiation efficiency over a frequency range from 3.1 to 10.6 GHz) has, so far, yet to be found.

Accordingly, it would be desirable to provide a wideband chip antenna fabricated on a dielectric substrate, which is suitable for integration in a portable wireless handset or terminal, where the bandwidth of the antenna extends over an ultra wide band frequency range, e.g. from 3.1-10.6 GHz, and where the antenna has dimensions which are small compared with the wavelength of the lower edge of the operating frequency band of the antenna.

SUMMARY OF THE INVENTION

From a first aspect, the invention provides an antenna comprising a first radiating structure located substantially in a first plane and having a feed point located substantially at a first end of said radiating structure; a second radiating structure located substantially in a second plane, said first plane being spaced apart from and substantially parallel with said second plane; and a block of dielectric material located substantially between said first and second radiating structures to provide a spacing between said first and second planes, wherein said second radiating structure comprises at least two spaced-apart, elongate radiating elements, each of said at least two radiating elements having a respective first end that is electrically connected to said first radiating structure substantially at a second end of said first radiating structure, said respective first end of said at least two radiating elements being substantially in register with said second end of said first radiating structure.

Preferably, said first radiating structure is provided on an obverse face of said dielectric block, and said second radiating structure is provided on a reverse face of said dielectric block. Alternatively, at least one of said first and second radiating structures is embedded in said dielectric block.

In preferred embodiments, said at least two radiating elements are substantially parallely disposed with respect to one another. Preferably, said at least two radiating elements extend substantially parallely with a central axis of said first radiating structure, said central axis passing through said first and second ends of the first radiating structure.

In some embodiments, said at least two radiating elements extend from their respective first end is a direction substantially towards said first end of the first radiating structure.

Alternatively, said at least two radiating elements extend from their respective first end is a direction substantially away from said first end of the first radiating structure.

Optionally, said second radiating structure comprises a centre radiating element extending substantially perpendicularly between said at least two radiating elements. Preferably, said centre radiating element is located substantially in register with said second end of said first radiating structure.

Preferably, said at least two radiating elements are substantially symmetrically arranged about a central axis running between said first and second ends of said first radiating structure.

In preferred embodiments, said first radiating structure comprises a substantially planar patch of electrically conductive material.

Typically, said first and second radiating structures are electrically connected by at least two spaced apart electrically conductive connectors, e.g. conductive vias or conductive traces. A respective electrically conductive connector connects each of said at least two radiating elements to said first radiating structure. Advantageously, said respective electrically conductive connectors are located substantially at an end of a respective one of said at least two radiating elements. Preferably, said respective electrically conductive connectors are substantially coplanar with a respective edge of a respective one of said at least two radiating elements.

A second aspect of the invention provides an antenna device comprising a substrate formed from an electrically insulating material; an antenna mounted on said substrate, said antenna comprising a first radiating structure located substantially in a first plane and having a feed point located substantially at a first end of said radiating structure; a second radiating structure located substantially in a second plane, said first plane being spaced apart from and substantially parallel with said second plane; and a block of dielectric material located substantially between said first and second radiating structures to provide a spacing between said first and second planes, wherein said second radiating structure comprises at least two spaced-apart, elongate radiating elements, each of said at least two radiating elements having a respective first end that is electrically connected to said first radiating structure substantially at a second end of said first radiating structure, said respective first end of said at least two radiating elements being substantially in register with said second end of said first radiating structure.

In preferred embodiments, said antenna is mounted on said substrate such that said second radiating structure is located substantially on an obverse face of said substrate.

Advantageously, a respective electrically conductive contact pad is provided on said obverse face of said substrate for each of said at least two radiating elements, the respective contact pad being substantially in register with and in contact with the respective radiating element. Preferably, an electrically conductive input/output contact pad is provided on said obverse face of said substrate, the electrically conductive input/output contact pad being substantially in register with and connected to said feed point.

Optionally, a ground plane is provided on said obverse face of the substrate, spaced apart from said antenna. In preferred embodiments, said ground plane comprises first and second adjacent portions spaced apart to define a gap therebetween, and wherein said signal feeding structure passes through said gap.

Antennas embodying the invention may provide a compact surface mountable chip antenna operating over a wide frequency range suitable for integration in portable handsets for wireless communications and other wireless terminals. The antennas have a relatively wide operating band and can be adapted for use in systems including but not limited to Ultra Wideband (UWB) or those defined by the IEEE 802.15 family of standards.

In a particularly preferred form, the antenna is a two-tier wideband antenna comprising a chip of a dielectric material with an upper radiating structure and a lower radiating structure, the dielectric chip being mounted on an insulating carrier substrate which includes a feed-line to connect the antenna to a transceiver device. The lower radiating structure comprises two elements which have a large aspect ratio so as to reduce the frequency of the lower band edge of the antenna when compared with a monopole patch antenna fabricated on a similar dielectric chip. The antenna of the present invention is suitable for operation over an ultra wideband, e.g. a frequency range extending from 3.1 to 10.6 GHz.

It will be understood that structures that are described herein as "radiating structures" radiate electromagnetic energy only during use, i.e. when excited by an appropriate electrical signal. Similarly, the term "radiating structures" used herein refers to structures which can be used to receive a signal when an electromagnetic wave is incident on thereon.

BRIEF DESCRIPTION OF THE DRAWINGS

Embodiments of the invention are now described by way of example and with reference to the accompanying drawings in which like numerals are used to denote like parts and in which.

DETAILED DESCRIPTION OF THE DRAWINGS

Figure 2:
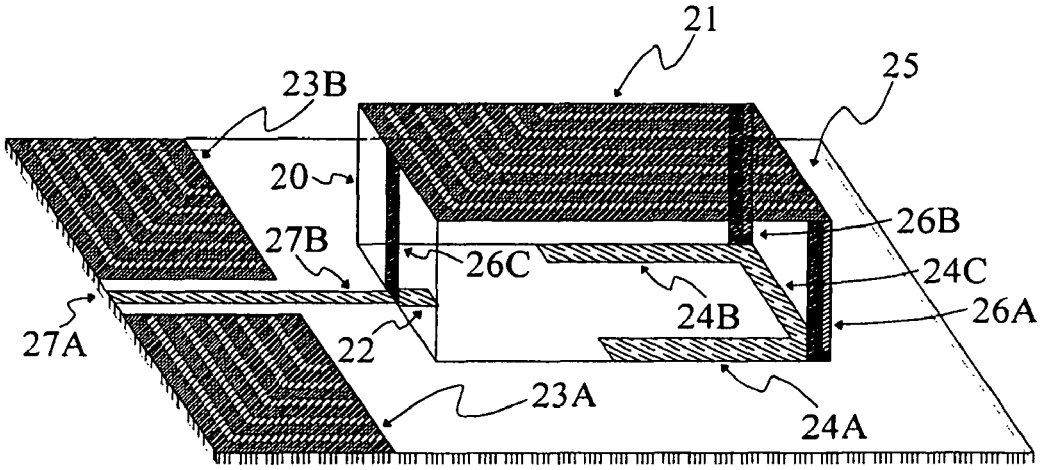
FIG. 2 is a perspective view of a two-tier chip antenna embodying the present invention.

FIG. 2 shows a two-tier wideband chip antenna embodying the present invention. The antenna of FIG. 2 comprises a block, or chip, 20 of a material with a dielectric constant which is greater than unity. Dielectric chip 20 is mounted in use on an insulating carrier substrate 25 which includes ground planes 23A, 23B, preferably disposed on the obverse face of insulating carrier substrate 25. Dielectric chip 20 is positioned on carrier substrate 25 so as to be offset from ground planes 23A, 23B. The chip 20 may be secured to the substrate 25 by any suitable means, e.g. solder.

Dielectric chip 20 has an obverse face on which a first, or upper, radiating structure 21 is provided, and a reverse face which is substantially flush with the obverse face of carrier substrate 25. The radiating structure 21, which is formed from any suitable electrically conductive material and is typically metallic, takes the preferred form of a planar, or patch, radiating element. In preferred embodiments, the planar radiating element 21 covers substantially the entire surface of the obverse face of the chip 20. Typically, the chip 20 is substantially rectangular in transverse and longitudinal cross-section. The radiating element 21 is typically substantially rectangular in shape.

The antenna has a feed point 22 which is preferably located on a reverse face of dielectric chip 20 and substantially in register with a first end of the upper radiating element 21, typically substantially at the midpoint of the first end. In the embodiment of FIG. 2, the feed point 22 is located on the lower surface and near an edge of dielectric chip 20 which is realized by a metal I/O pad 22 disposed on the lower surface of dielectric chip 20. I/O pad 22, is electrically connected to upper radiating element 21 by a conducting metal trace 26C.

A second, or lower, radiating structure is provided on the reverse face of the chip 20. The lower radiating structure comprises three radiating elements namely spaced apart, elongate side elements 24A and 24B, and centre element 24C which joins side elements 24A, 24B together. Lower radiating side elements 24A and 24B are electrically connected to upper radiating element 21 by conducting metal trace lines 26A and 26B respectively. The trace lines 26A, 26B may be located on a respective side face of the block 20, or on the end face, as is convenient. It will be seen that the upper radiating element 21 and the lower radiating elements 24A, 24B, 24C are spaced apart from one another by the chip 20, the trace lines 26A, 26B providing the only interconnection. Preferably, the arrangement is such that the upper radiating element 21 and the lower radiating elements 24A, 24B, 24C are disposed in respective substantially parallel planes.

In preferred embodiments, each side element 24A, 24B has a first end that is substantially in register with each other and with the end of the first radiating element 21, in particular, the end of the first radiating element 21 that is distal the feed point 22. Conveniently, the side elements 24A, 24B are each connected to said first radiating element at their first end, the respective connection being between the respective first end of the side element 24A, 24B and the end of the radiating element 21. This may be seen by way of example from FIG. 2 wherein the trace lines 26A and 26B are located substantially at the ends of the respective radiating elements 21, 24A, 24B. It is also preferred that the centre element 24C extends between the respective first ends of the side elements 24A, 24B. The side elements 24A, 24B are preferably substantially parallel with one another. Each side element 24A, 24B advantageously runs substantially parallel with, and preferably still substantially in register with, a respective edge of the upper radiating element 21. The centre element 24C preferably runs substantially perpendicular to the side elements 24A, 24B. In preferred embodiments, the centre element 24C extends substantially in register with and substantially parallel with the end of the upper radiating element 21.

In the embodiment of FIG. 2, each side element 24A, 24B extends from its first end in a direction towards the other end of the first radiating element 21, i.e. generally towards the feed point 22. Hence, the side elements 24A, 24B run substantially beneath the upper radiating element 21. The side elements 24A, 24B, which are preferably of substantially the same length, may be dimensioned to extend wholly or partly along the length of the chip 20. The length of the side elements 24A, 24B from their first end to their free end may be less than, greater than, or substantially equal to the end-to-end length of the upper radiating element 21. Advantageously, the side elements 24A, 24B are arranged substantially symmetrically about a central axis that runs from one end of the first radiating element 21 to the other, typically the longitudinal axis of the radiating element 21. In preferred embodiments, the feed point 22 is located substantially on, or at least substantially in register with said central axis.

Electrical connection between the antenna and a transceiver device (not shown) is made by a feed-line, which has two sections 27A and 27B. Section 27A of the feed-line is preferably a coplanar waveguide structure bounded on both sides by ground planes 23A and 23B; section 27B of the feed-line extends between and connects co-planar waveguide feed-line section 27A and I/O pad 22. Alternative options for section 27A of the feed line include, a microstrip line, a grounded coplanar waveguide, a coaxial line, or a stripline.

The offset of dielectric chip 20 from ground planes 23A and 23B is selected for optimum performance of the antenna; typically this offset is less than the longitudinal dimension of dielectric chip 20. Ground planes 23A and 23B may alternatively be realized by a single ground plane which may be arranged on the upper surface of carrier substrate 25, or on the lower surface thereof. Alternatively one or more ground planes may be arranged on some other remotely located substrate (not shown).

In FIG. 2, upper radiating element 21 is shown so that it covers the entire obverse face of dielectric chip 20; however, upper radiating element 21 may be arranged so that it only partially covers the obverse face of dielectric chip 20. In particular, upper radiating element 21 may be arranged so that it tapers away from ground planes 23A and 23B, as the distance from metal trace line 26C increases.

In FIG. 2, upper radiating element 21 and lower radiating elements 24A, 24B and 24C are shown on the obverse and reverse faces of dielectric chip 20. This arrangement is suitable when the antenna is fabricated from a dielectric chip. An alternative arrangement has the upper radiating element embedded inside dielectric chip 20 and near the obverse face thereof. Similarly, lower radiating elements 24A, 24B and 24C may be embedded near the reverse face of dielectric chip 20.

Figure 3:
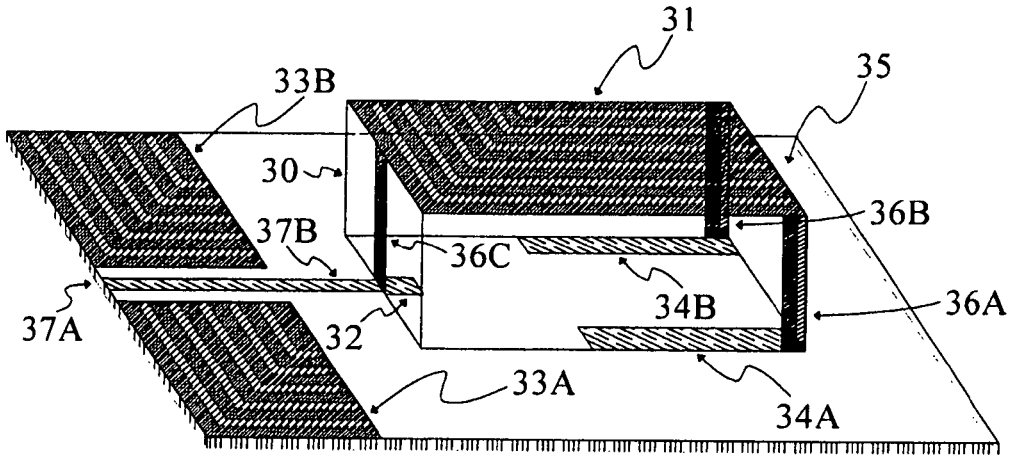
FIG. 3 is a perspective view of an alternative two-tier chip antenna embodying the present invention.

FIG. 3 shows an alternative two-tier wideband chip antenna embodying the invention. In this embodiment, the centre element between side elements of the lower radiating structure is omitted. Otherwise, the antenna of FIG. 3 is substantially similar to the antenna of FIG. 2 and the same description applies as would be understood by a skilled person. The antenna of FIG. 3 comprises a chip 30 of a material with a dielectric constant which is greater than unity. Dielectric chip 30 is mounted on an insulating carrier substrate 35 which includes ground planes 33A, 33B, preferably disposed on the upper surface of insulating carrier substrate 35. Dielectric chip 30 has an obverse face on which a radiating element 31 is provided, and a reverse face which is substantially flush with the upper surface of carrier substrate 35. Dielectric chip 30 is positioned on carrier substrate 35 so as to be offset from ground planes 33A, 33B. A pair of lower metallic radiating elements 34A and 34B are provided on the reverse face of dielectric chip 30. Lower radiating element 34A is connected to upper radiating element 31 by conducting metal trace lines 36A, similarly lower radiating element 34B is connected to upper radiating element 31 by conducting metal trace lines 36B.

The antenna of FIG. 3 has a feed point on the reverse face and near an edge of dielectric chip 30 which is realized by a metal I/O pad 32 disposed on the reverse face of dielectric chip 30. I/O pad 32 is connected to upper radiating element 31 by a conducting metal trace 36C.

Electrical connection between a transceiver device (not shown) is made by a feed-line, which has two sections 37A and 37B. Section 37A of the feed-line is preferably a coplanar waveguide structure bounded on both sides by ground planes 33A and 33B; section 37B of the feed-line extends between and connects co-planar waveguide feed-line section 37A and metal I/O pad 32.

Figure 4:
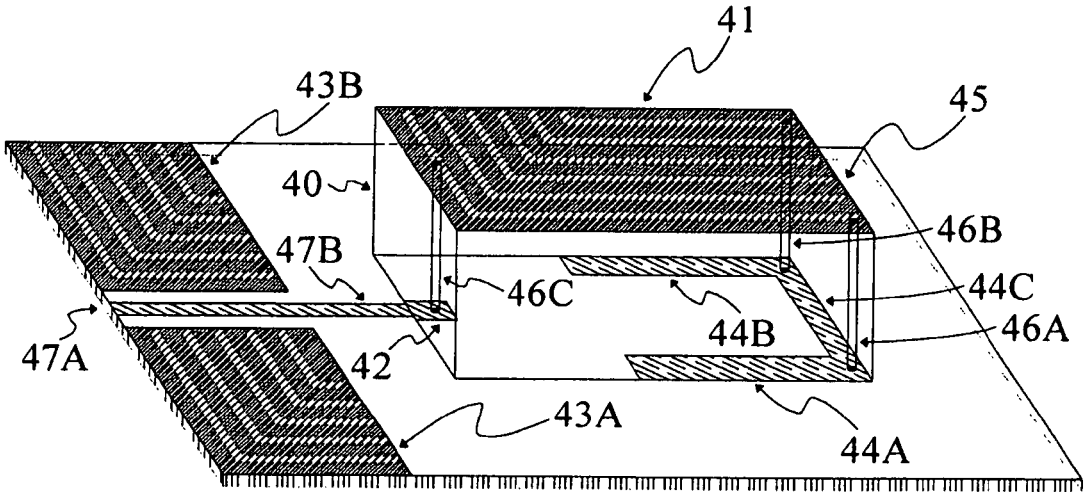
FIG. 4 is a perspective view of a further alternative two-tier chip antenna embodying the present invention.

FIG. 4 shows a further alternative two-tier wideband chip antenna embodying the invention. In this embodiment, the metal trace lines are replaced by conductive vias 46A, 46B, 46C. Otherwise, the antenna of FIG. 4 is substantially similar to the antenna of FIG. 2 and the same description applies as would be understood by a skilled person. The antenna of FIG. 4 comprises a chip 40 of a material with a dielectric constant which is greater than unity. Dielectric chip 40 is mounted on an insulating carrier substrate 45 which includes ground planes 43A, 43B, preferably disposed on the upper surface of insulating carrier substrate 45. Dielectric chip 40 has an obverse face on which a metallic radiating element 41 is provided, and a reverse face which is substantially flush with the upper surface of carrier substrate 45. Dielectric chip 40 is positioned on carrier substrate 45 so as to be offset from ground planes 43A, 43B. A lower metallic radiating element comprising side elements 44A and 44B and centre element 44C is provided on the reverse face of dielectric chip 40. Lower radiating structure side elements 44A and 44B are connected to upper radiating element 41 by conductive vias 46A and 46B respectively. The vias 46A, 46B take the form of through holes which penetrate dielectric chip 40 and are lined or filled with a conductive material, typically metal.

The antenna of FIG. 4 has a feed point on the reverse face and near an edge of dielectric chip 40 which is realized by a metal I/O pad 42 disposed on the reverse face of dielectric chip 40. I/O pad 42, is connected to upper radiating element 41 by a conducting metal plated or metal filled through hole 46C.

Electrical connection between a transceiver device (not shown) is made by a feed-line, which has two sections 47A and 47B. Section 47A of the feed-line is preferably a coplanar waveguide structure bounded on both sides by ground planes 43A and 43B; section 47B of the feed-line extends between and connects co-planar waveguide feed-line section 47A and I/O pad 42.

Figure 1:
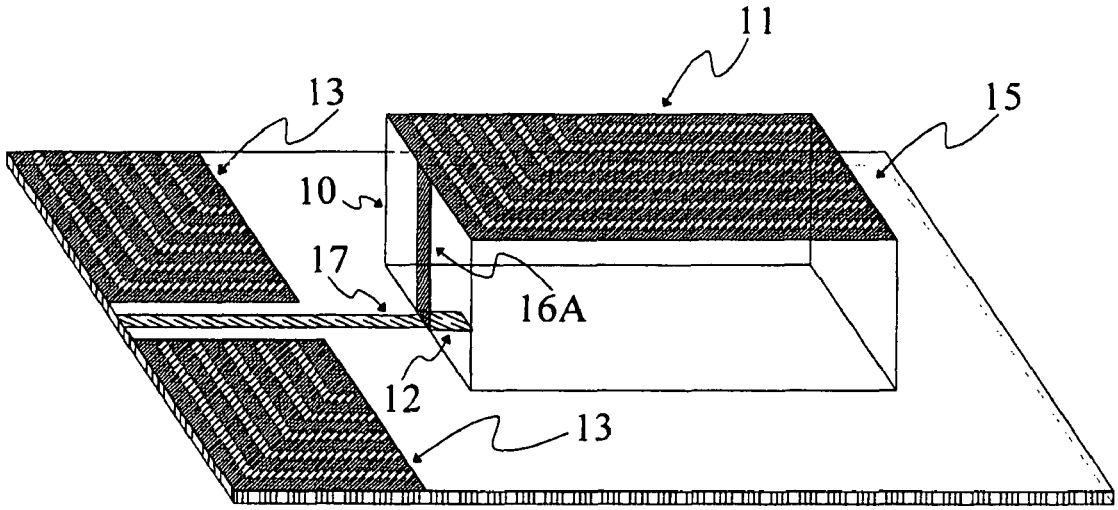
Fig. 1 (Prior Art)
FIG. 1 is a perspective view of a monopole chip antenna according to the existing art.
Figure 5:
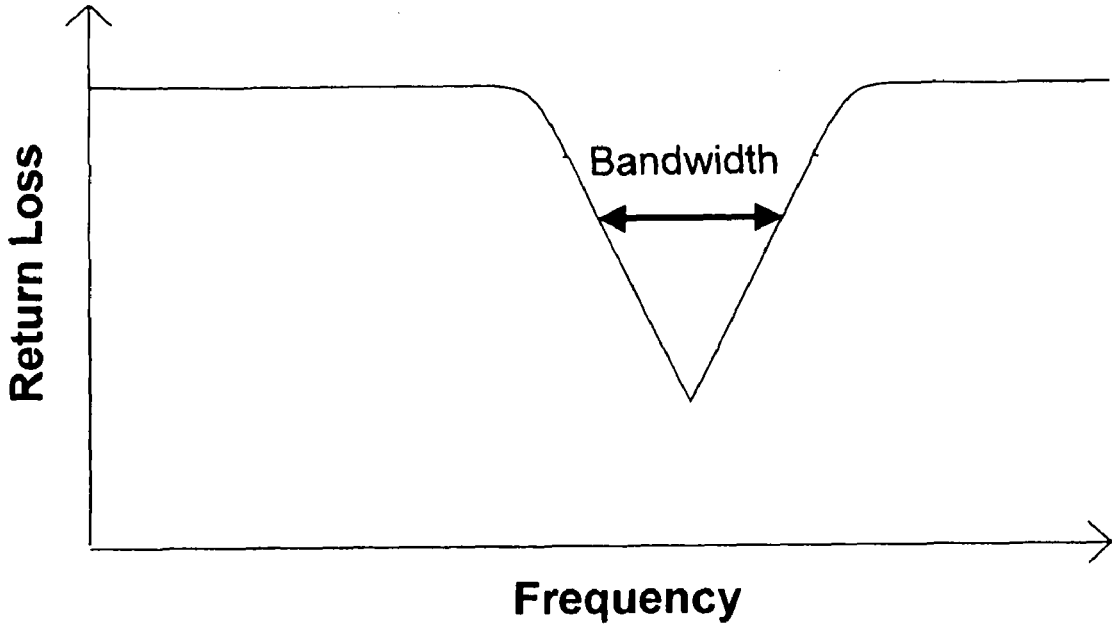
FIG. 5 shows a return loss frequency response of a monopole chip antenna.

FIG. 5 shows a return loss frequency response plot which is typical of the monopole chip antenna of FIG. 1. The antenna typically has a centre frequency determined by the physical dimensions of the radiating element 11, and the dielectric constant of the material forming dielectric chip 10. As a general guideline, the longest path from the input of the antenna at 12 to the furthest extremity will be in the order of one quarter of the wavelength of the centre frequency of operation. The bandwidth is determined by several factors including the ratio of X and Y (transverse and longitudinal) dimensions of the element 11, the material of the substrate, and the proximity of the radiating element 11 to its applicable ground plane 13.

Figure 6:
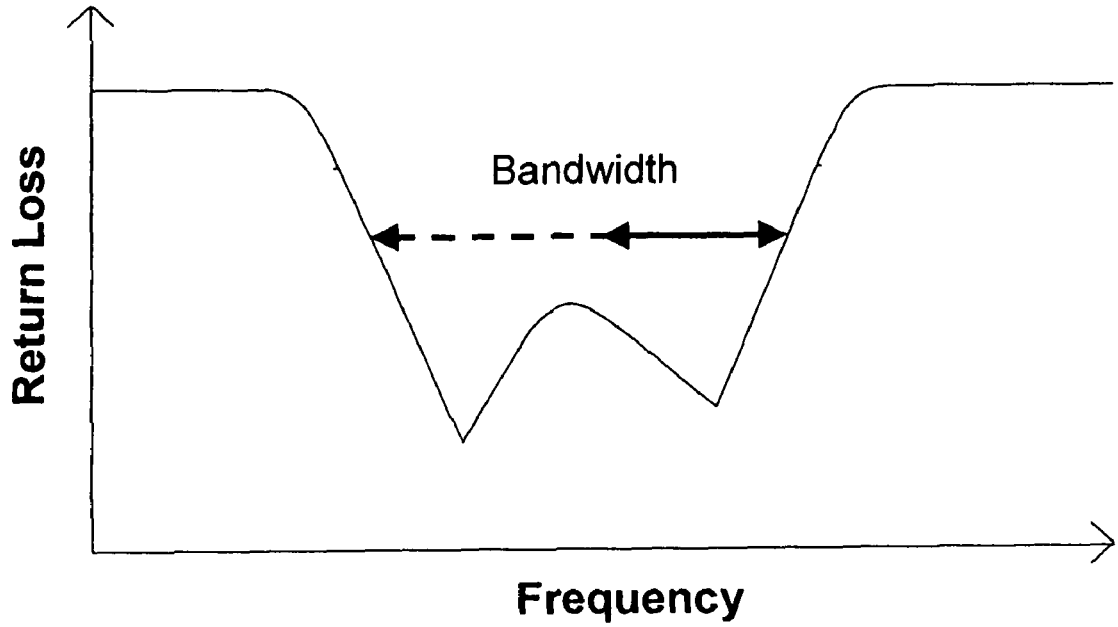
FIG. 6 shows an exemplary return loss frequency response of a two-tier chip antenna embodying the present invention.

FIG. 6 shows a return loss frequency response plot resulting from the two-tier wideband antenna of FIG. 2. The effect of lower radiating structure comprising side elements 24A and 24B and centre element 24C on the frequency response is to produce a second resonance at a lower frequency than that arising from upper resonating element 21. Consequently, the lower resonating element has two beneficial effects: the bandwidth of the antenna is extended; an effectively larger antenna is produced compared to a monopole chip antenna with the same physical dimensions of the antenna of FIG. 2.

Figure 7:
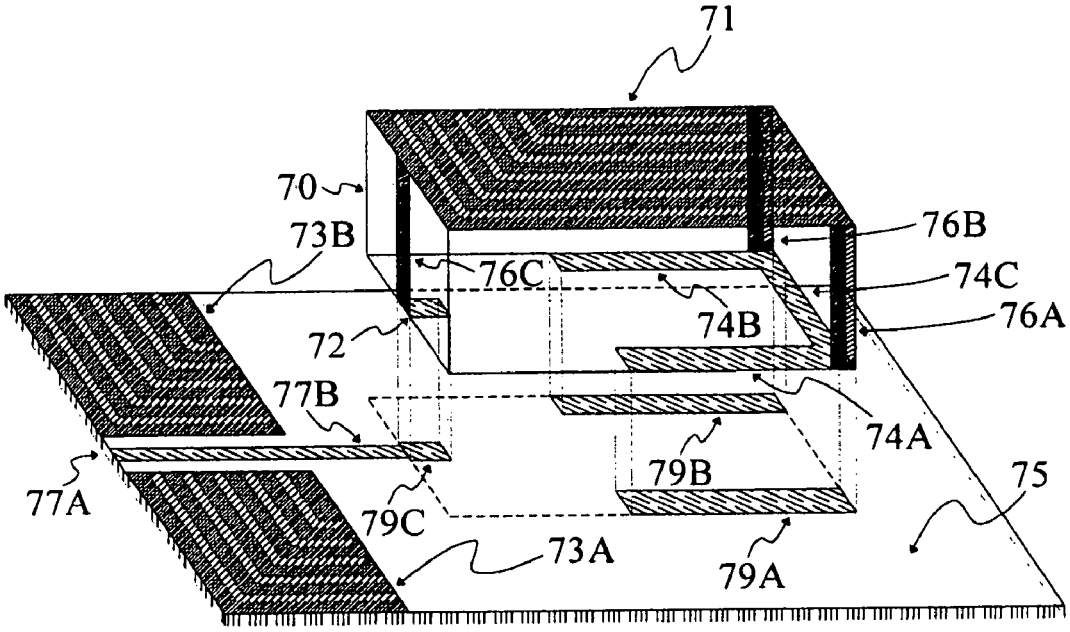
FIG. 7 is an exploded perspective view of the two-tier chip antenna of FIG. 2 and a carrier substrate to which the antenna is attached in use.

FIG. 7 shows an exploded diagram of a two-tier chip antenna embodying the present invention and the carrier substrate to which the antenna is attached. The antenna depicted in FIG. 7 has all of the features of the antenna of FIG. 2, where the numerals which identify the features of the antenna of FIG. 2 correspond to those of FIG. 7 but incremented by 50. The dielectric chip 70 of the antenna of FIG. 7 is shown raised from carrier substrate 75 to reveal a landing pattern on the carrier substrate which comprises landing pads 79A, 79B and 79C, the pads being formed from a conductive material, typically metal. Preferably, when dielectric chip 70 is mounted on carrier substrate 75, the lower radiating elements 74A and 74B are substantially aligned and engaged with landing metal pads 79A and 79B respectively. Similarly, I/O pad 72 will be substantially aligned and engaged with landing metal pad 79C.

Advantageously, the frequency response of the antenna can be tuned by selecting a shape and/or size of landing metal pads 79A and 79B. Specifically landing pads 79A and 79B can be widened or elongated so as to effect slight changes in the return loss frequency response of the antenna to suit a particular application. In particular, landing pads 79A, 79B may be made larger then, smaller than or substantially the same size as the elements 74A, 74B, and/or may take different shapes than the elements 74A, 74B.

Figure 8:
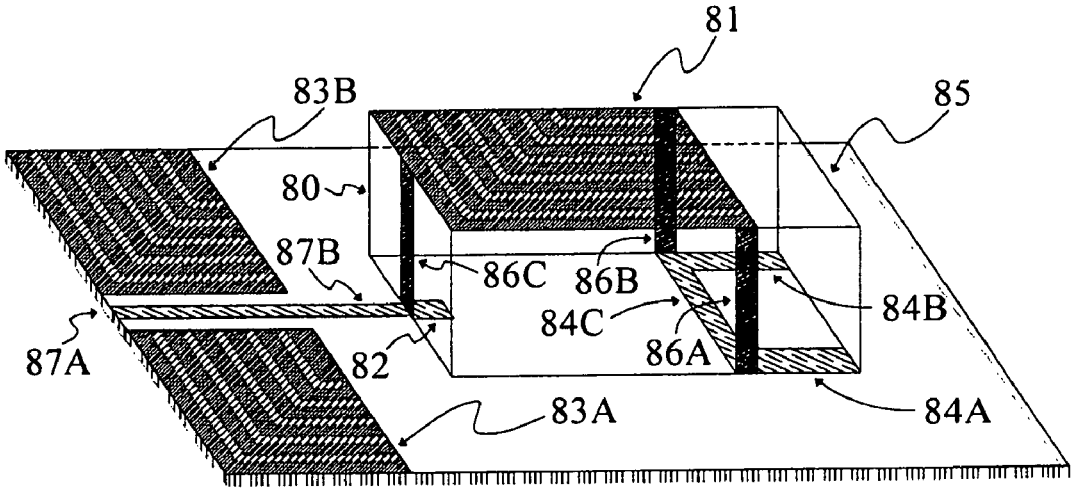
FIG. 8 shows a still further alternative two-tier chip antenna embodying the present invention.

FIG. 8 shows a further alternative two-tier wideband chip antenna embodying the invention. In this embodiment, the lower radiating elements 84A, 84B extend from their respective first end in a direction away from the other end of the first radiating element 81, i.e. generally away from the feed point 82. It is preferred that the lower radiating elements 84A, 84B, 84C is provided on the reverse face of the chip 80 and that the first radiating element 81 does not cover the entire obverse face of the chip 80 so that there is substantially no overlap of the upper and lower radiating structures (although some overlap may be present at the first ends of the side elements 84A, 84B and at the centre element 84C when present). Otherwise, the antenna of FIG. 8 is substantially similar to the antenna of FIG. 2 and the same description applies as would be understood by a skilled person. It will be understood that in alternative embodiments, the centre element 84C may be omitted, and/or the trace lines 86A, 86B, 86C may be replaced with vias, or other conductive connectors. Alternatively still, the radiating side elements 84A, 84B may extend beyond the chip 80, e.g. the chip 80 may be dimensioned to extend no further than the upper radiating element 81. By way of example, this may be achieved by fabricating lower radiating side elements 84A, 84B on the surface of a carrier substrate 85.

The antenna of FIG. 8 comprises a chip, 80 where the material of the chip has a dielectric constant that is greater than unity. Dielectric chip 80 is mounted on insulating carrier substrate 85 which includes ground planes 83A, 83B on the upper surface thereof. Dielectric chip 80 has an obverse face which is partially covered by metallic radiating element 81, and a reverse face which is substantially flush with the upper surface of carrier substrate 85. Dielectric chip 80 is positioned on carrier substrate 85 so as to be offset from ground planes 83A, 83B. A lower metallic radiating structure comprising elements 84A, 84B and 84C is provided on the reverse face of dielectric chip 80. Lower radiating structure elements 84A and 84B are connected to upper radiating element 81 by conducting metal trace lines 86A and 86B respectively.

The antenna of FIG. 8 has a metal I/O feed pad 82 disposed on the reverse face of dielectric chip 80. I/O pad 82, is connected to upper radiating element 81 by a conducting metal trace 86C. Electrical connection between a transceiver device (not shown) is made by a feed-line, comprising two sections 87A and 87B. Section 87A of the feed-line is preferably a coplanar waveguide structure bounded on both sides by ground planes 83A and 83B; section 87B of the feed-line extends between and connects co-planar waveguide feed-line section 87A and I/O pad 82.

For each of the antennas of FIGS. 2, 3, 4, and 8, a feed line comprising a section which has the structure of coplanar waveguide, 27A, 37A, 47A and 87A has been described; however alternative options for this section of the feed line include, a microstrip line, a grounded coplanar waveguide, a coaxial line, or a stripline.

Figures 10, 11:
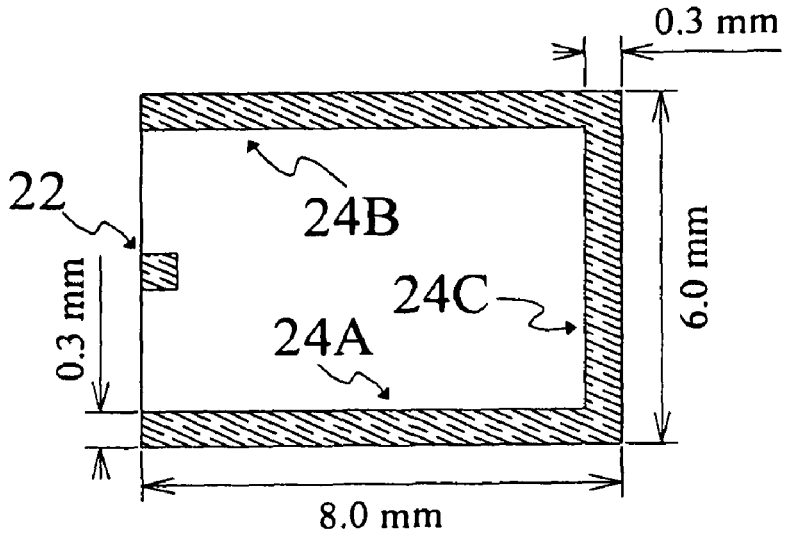
FIG. 10 shows a drawing giving the physical dimensions of lower radiating structure comprising elements 24A, 24B and 24C used by way of example for the electromagnetic simulation of the antenna depicted in FIG. 2, the results of which are shown in FIG. 9*b*.
FIG. 11 is a table showing the frequency allocations of the UWB system as defined by the WiMedia Alliance.

Though the UWB system extends over a frequency range from 3.1 GHz to 10.6 GHz, it is generally divided into sub-bands according to the system in use. Table 1 of FIG. 11 shows the band allocations of the UWB system as defined by the WiMedia Alliance. The WiMedia alliance UWB system is divided into 5 separate band groups, where each band group is further divided into 3 bands (2 in the case of band group five) which are 528 MHz wide.

It will be noted that Band Group #2 of the UWB system presented in table 1 has a frequency range from 4752 to 6336 MHz. On the other hand, the 802.11a Wireless LAN system has a frequency range which can extend from 4910 to 5835 MHz—the frequency allocations vary from one region to another. Thus, the majority of UWB applications do not use the portion of the bandwidth between 5 and 6 GHz. Hence, good frequency characteristics of a UWB antenna are typically not required in Band Group #2; in fact, an antenna which has poor radiation efficiency within UWB Band Group #2 is more desirable than a similar antenna with good radiation efficiency in this band since the antenna with poor radiation efficiency will offer higher isolation of RF signals from the 802.11a system.

Figure 9A:
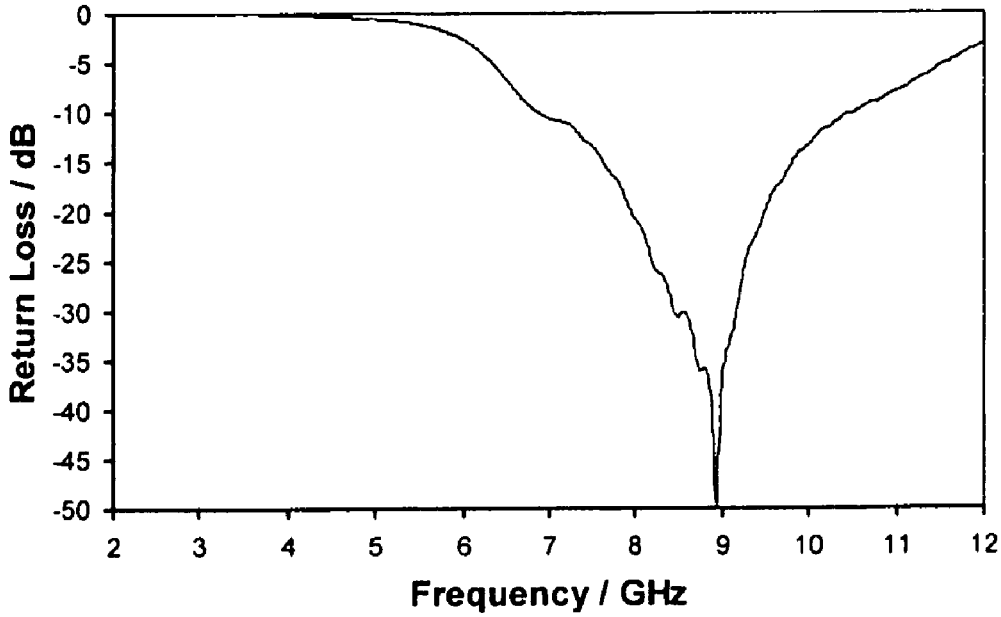
FIG. 9*a* shows a return loss frequency response resulting from an electromagnetic simulation of the monopole patch antenna depicted in FIG. 1.

FIG. 9A shows a return loss frequency response resulting from an electromagnetic simulation carried out on the antenna depicted in FIG. 1 where the dimensions of the dielectric chip 10 are 8×6×1 mm and where the dielectric constant of the material of the dielectric chip 10 is 20.

Figure 9B:
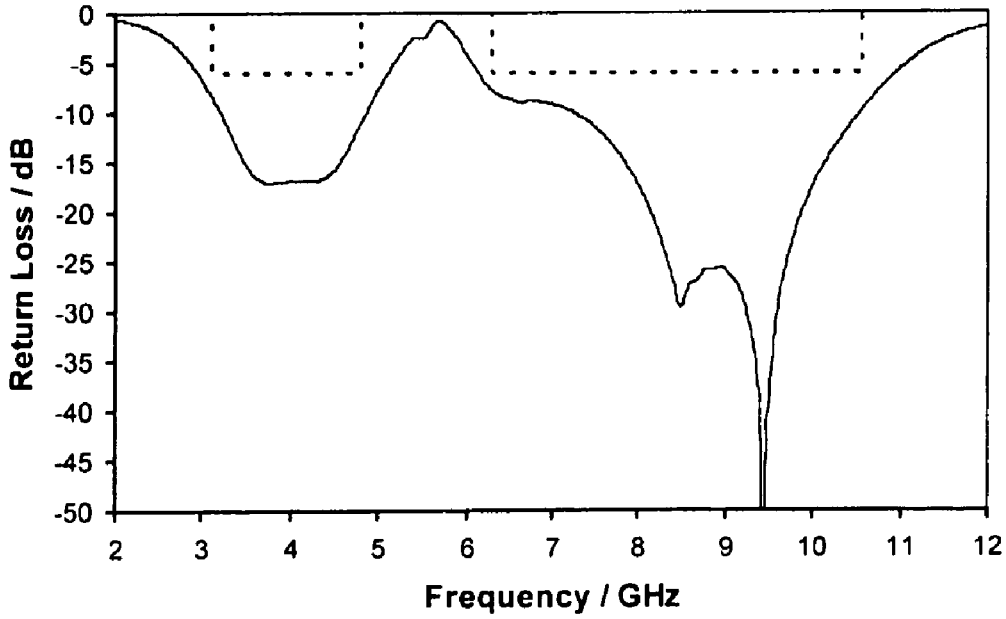
FIG. 9*b* shows a return loss frequency response resulting from an electromagnetic simulation of the two-tier wideband antenna depicted in FIG. 2.

FIG. 9B shows a return loss frequency response resulting from an electromagnetic simulation carried out on an antenna as depicted in FIG. 2, where, similar to FIG. 9A, the dimensions of the dielectric chip 20 are, by way of example, 8×6×1 mm and where the dielectric constant of the dielectric chip 20 is, for example, 20. It can be seen that the electrical characteristics shown in FIG. 9B which correspond to the antenna of FIG. 2 are ideal for the UWB system, offering a return loss of less than −6 dB over UWB band group #1 and also over UWB band group #3, band group #4 and band group #5. As mentioned in the preceding text, the poor return loss of the antenna of FIG. 2 in the frequency range from 5 to 6 GHz is a positive characteristic, because this corresponds to the 802.11a frequency band, where additional isolation is a benefit in a UWB application.

It can be seen from FIG. 9B that antennas embodying the present invention advantageously have a wider band of operation when compared with the monopole patch antenna of similar dimensions such as that depicted in FIG. 1. For example, the lower edge of the return loss frequency response of the antenna of FIG. 2 has been shifted downwards in frequency by several GHz. The reduction in the frequency of the lower band edge of the frequency response of antennas embodying the present invention arises from the fact that several electrical paths are provided from the feed point to the furthest extremity of the antenna which are substantially longer than the longest electrical path of the monopole patch antenna of FIG. 1. Thus, the structure of the antenna comprising upper and lower resonating structures connected as described in the various embodiments above gives rise to the wider bandwidth of antennas embodying the present invention. Furthermore, since preferred embodiments of the present invention provide an antenna with a return loss frequency response having a lower band-edge which is several GHz lower in frequency than that of a similarly sized patch antenna, it is apparent that the antenna embodying the present invention provide a response which would typically require a structure of physically larger dimensions.

FIG. 10 shows a drawing giving an example of suitable physical dimensions of lower radiating structure comprising elements 24A 24B and 24C, as used for the electromagnetic simulation of the antenna depicted in FIG. 2, the results of which are shown in FIG. 9B.

The invention is not limited to the embodiments described herein which may be modified or varied without departing from the scope of the invention.

The invention claimed is:

1. An antenna comprising a first radiating structure located substantially in a first plane and having a feed point located substantially at a first end of said radiating structure; a second radiating structure located substantially in a second plane, said first plane being spaced apart from and substantially parallel with said second plane; and a block of dielectric material located substantially between said first and second radiating structures to provide a spacing between said first and second planes, wherein said second radiating structure comprises at least two spaced-apart, elongate radiating elements, each of said at least two radiating elements having a respective first end that is electrically connected to said first radiating structure substantially at a second end of said first radiating structure, said respective first end of said at least two radiating elements being substantially in register with said second end of said first radiating structure.

2. An antenna as claimed in claim 1, wherein said first radiating structure is provided on an obverse face of said dielectric block, and said second radiating structure is provided on a reverse face of said dielectric block.

3. An antenna as claimed in claim 1, wherein at least one of said first and second radiating structures is embedded in said dielectric block.

4. An antenna as claimed in claim 1, wherein said at least two radiating elements are substantially parallely disposed with respect to one another.

5. An antenna as claimed in claim 4, wherein said at least two radiating elements extend substantially parallely with a central axis of said first radiating structure, said central axis passing through said first and second ends of the first radiating structure.

6. An antenna as claimed in claim 1, wherein said at least two radiating elements extend from their respective first end is a direction substantially towards said first end of the first radiating structure.

7. An antenna as claimed in claim 1, wherein said at least two radiating elements extend from their respective first end is a direction substantially away from said first end of the first radiating structure.

8. An antenna as claimed in claim 1, wherein said second radiating structure comprises a centre radiating element extending substantially perpendicularly between said at least two radiating elements.

9. An antenna as claimed in claim 8, wherein said centre radiating element is located substantially in register with said second end of said first radiating structure.

10. An antenna as claimed in claim 1, wherein said at least two radiating elements are substantially symmetrically arranged about a central axis running between said first and second ends of said first radiating structure.

11. An antenna as claimed in claim 1, wherein said first radiating structure comprises a substantially planar patch of electrically conductive material.

12. An antenna as claimed in claim 1, wherein said first and second radiating structures are electrically connected by at least two spaced apart electrically conductive connectors.

13. An antenna as claimed in claim 12, wherein a respective electrically conductive connector connects each of said at least two radiating elements to said first radiating structure.

14. An antenna as claimed in claim 13, wherein said respective electrically conductive connectors are located substantially at an end of a respective one of said at least two radiating elements.

15. An antenna as claimed in claim 14, wherein said respective electrically conductive connectors are substantially coplanar with a respective edge of a respective one of said at least two radiating elements.

16. An antenna as claimed in claim 12, wherein said respective electrically conductive connectors comprise a respective through hole lined or filled with an electrically conductive material.

17. An antenna device comprising a substrate formed from an electrically insulating material; an antenna mounted on said substrate, said antenna comprising a first radiating structure located substantially in a first plane and having a feed point located substantially at a first end of said radiating structure; a second radiating structure located substantially in a second plane, said first plane being spaced apart from and substantially parallel with said second plane; and a block of dielectric material located substantially between said first and second radiating structures to provide a spacing between said first and second planes, wherein said second radiating structure comprises at least two spaced-apart, elongate radiating elements, each of said at least two radiating elements having a respective first end that is electrically connected to said first radiating structure substantially at a second end of said first radiating structure, said respective first end of said at least two radiating elements being substantially in register with said second end of said first radiating structure.

18. An antenna device as claimed in claim 17, wherein said antenna is mounted on said substrate such that said second radiating structure is substantially flush with an obverse face of said substrate.

19. An antenna device as claimed in claim 17, wherein an electrically conductive input/output contact pad is provided on said obverse face of said substrate, the input/output contact pad being substantially in register with and connected to said feed point.

20. An antenna device as claimed in claim 17, wherein a respective electrically conductive contact pad is provided on said obverse face of said substrate for each of said at least two radiating elements, the respective contact pad being substantially in register with and in contact with the respective radiating element.

21. An antenna device as claimed in claim 17, wherein a ground plane is provided on said obverse face of the substrate, spaced apart from said antenna.

22. An antenna device as claimed in claim 21, wherein said ground plane comprises first and second adjacent portions spaced apart to define a gap therebetween, and wherein said signal feeding structure passes through said gap.

* * * * *